US009663283B2

(12) United States Patent
Uesugi et al.

(10) Patent No.: US 9,663,283 B2
(45) Date of Patent: May 30, 2017

(54) PACKAGING BAG

(71) Applicants: KYORAKU CO., LTD., Kyoto (JP); ORIHIRO CO., LTD., Gunma (JP)

(72) Inventors: Tomohiro Uesugi, Tokyo (JP); Shinji Matsunaga, Fukuoka (JP); Orihiro Tsuruta, Gunma (JP)

(73) Assignees: KYORAKU CO., LTD., Kyoto (JP); ORIHIRO CO., LTD., Gunma (JP)

( * ) Notice: Subject to any disclaimer, the term of this patent is extended or adjusted under 35 U.S.C. 154(b) by 0 days.

(21) Appl. No.: 14/780,205

(22) PCT Filed: Mar. 20, 2014

(86) PCT No.: PCT/JP2014/057769
§ 371 (c)(1),
(2) Date: Sep. 25, 2015

(87) PCT Pub. No.: WO2014/156955
PCT Pub. Date: Oct. 2, 2014

(65) Prior Publication Data

US 2016/0046426 A1 Feb. 18, 2016

(30) Foreign Application Priority Data

Mar. 26, 2013 (JP) ..... 2013-064093
Mar. 26, 2013 (JP) ..... 2013-064097

(51) Int. Cl.
*B65D 75/00* (2006.01)
*B65D 75/58* (2006.01)
*B65D 75/44* (2006.01)

(52) U.S. Cl.
CPC ..... *B65D 75/5855* (2013.01); *B65D 75/44* (2013.01)

(58) Field of Classification Search
CPC ..... B32B 27/08; B65D 33/34; B65D 75/30; B65D 75/44; B65D 75/5855; Y10T 428/1462; A61F 9/0008
(Continued)

(56) References Cited

U.S. PATENT DOCUMENTS 3,342,326 A * 9/1967 Zackheim ..... A61J 1/067 206/438
4,150,744 A * 4/1979 Fennimore ..... A61J 1/16 206/205
(Continued)

FOREIGN PATENT DOCUMENTS

EP 0959021 A1 11/1999
JP 64-053075 U 3/1989
(Continued)

OTHER PUBLICATIONS

International Search Report dated Jul. 1, 2014 from corresponding International Patent Application No. PCT/JP2014/057769; 4 pgs.

*Primary Examiner* — Peter Helvey
(74) *Attorney, Agent, or Firm* — Maier & Maier, PLLC

(57) ABSTRACT

Provided is a packaging bag which can prevent the entry of water between a handle and a body, as well as can maintain proper degrees of easy-opening properties and bag-break strength. A packaging bag includes an easy-peel seal. The seal includes first regions in which multiple belt-shaped seals are spaced from each other in the width direction and second regions in which a single belt-shaped seal is disposed. The first regions and second regions are alternately disposed adjacent to each other in the length direction of the belt-shaped seals. The single belt-shaped seal in each second region has a wide width so that the multiple belt-shaped seals in the adjacent first regions can be connected to the single belt-shaped seal.

5 Claims, 9 Drawing Sheets

(58) Field of Classification Search
USPC ..... 383/210, 211
See application file for complete search history.

(56) References Cited

U.S. PATENT DOCUMENTS

| | | | | | |
|---|---|---|---|---|---|
| 4,709,397 | A * | 11/1987 | Voshall | B65D 27/30 | 206/459.1 |
| 5,389,686 | A * | 2/1995 | Diop | C07C 217/48 | 514/649 |
| 5,622,432 | A * | 4/1997 | Zicker | B65D 75/5827 | 383/120 |
| 5,885,673 | A * | 3/1999 | Light | B32B 27/08 | 206/455 |
| 6,279,297 | B1 * | 8/2001 | Latronico | B65B 61/18 | 53/139.2 |
| 6,287,658 | B1 * | 9/2001 | Cosentino | B32B 7/06 | 206/411 |
| 6,333,061 | B1 | 12/2001 | Vadhar | | |
| 6,929,400 | B2 * | 8/2005 | Razeti | B65D 75/20 | 229/87.05 |
| 7,329,240 | B2 * | 2/2008 | Mesa | A61M 5/002 | 604/138 |
| 7,740,923 | B2 * | 6/2010 | Exner | B65D 75/5855 | 206/807 |
| 2006/0200098 | A1 | 9/2006 | Von Falkenhausen | | |
| 2008/0112654 | A1 | 5/2008 | Matsunaga | | |
| 2008/0203141 | A1 * | 8/2008 | Friebe | B41M 1/22 | 229/87.05 |
| 2008/0223007 | A1 | 9/2008 | Friebe et al. | | |

FOREIGN PATENT DOCUMENTS

| | | | |
|---|---|---|---|
| JP | 06-025161 | U | 4/1994 |
| JP | 07-101463 | A | 4/1995 |
| JP | 10-181770 | A | 7/1998 |
| JP | 3921236 | B2 | 5/1999 |
| JP | 2011-235913 | A | 11/2011 |
| WO | 9822282 | A1 | 5/1998 |
| WO | 2006038700 | A1 | 4/2006 |

* cited by examiner

PACKAGING BAG

TECHNICAL FIELD

The present invention relates to a packaging bag in which a target object such as food or the like is packaged and in particular to a packaging bag including a seal.

BACKGROUND ART

In a packaging bag for packaging a target object such as a food material, edges of a bent film are sealed with a seal, and the target object is contained in the resulting containing space. When a consumer takes out the target object, he or she peels the seal sealing the opening to open the bag. Such a packaging bag is manufactured as follows: containing space, which is partially opened, is formed by bending a film and then sealing the side edges of the film; a target object is charged into the containing space through the opening; and then the opening is sealed.

Patent Literature 1 discloses a packaging bag which is formed by bending a film, overlapping the side edges of the film by envelope seaming., and forming a seal in the overlapping region, and a manufacturing method thereof. Patent Literature 3 discloses a packaging bag which is formed by bending a film, overlapping the side edges of the film by butt seaming, and forming a seal in the overlapping part, and a manufacturing method thereof.

Some of packaging bags include a easy-peel seal (easy-opening portion) for easy-opening. These packaging bags are formed by bonding together the edges of a film by envelope seaming or butt seaming and then forming a easy-peel seal in the bonded region.

Patent Literature 1 discloses a packaging bag which is formed by bending a film into a tubular shape, overlapping the edges of the film, and forming multiple longitudinal seals having easy-peel properties in the overlapping region.

Patent Literature 2 discloses a packaging bag which is formed by bending a film, overlapping edges of the film by butt seaming, and forming a easy-peel seal in the overlapping region.

CITATION LIST

Patent Literature

Patent Literature 1: Japanese Unexamined Utility Model Registration Application Publication No. 64-53075

Patent Literature 2: Japanese Unexamined Patent Application Publication No. 10-181770

Patent Literature 3: Japanese Patent No. 3921236

SUMMARY OF INVENTION

Technical Problem

However, if the bondability of an easy-peel seal is too low, the bag-break strength of the bag will be reduced. Such a seal would be peeled unintentionally. On the other hand, if the bondability of an easy-peel seal is too high, the bag would not be easily opened, or the contents would burst out due to the impact when opening the bag. As seen above, for a packaging bag including an easy-peel seal, it is very important that the seal have proper degrees of openability and bag-break strength Further, when a traditional packaging bag is water-cooled, some water enters between the seal edge serving as a handle and the body of the packaging bag, and such water is difficult to remove even through a drying step.

The present invention has been made in view of the foregoing, and an object thereof is to provide a packaging bag which can prevent the entry of water between the handle and the body, as well as can maintain proper degrees of openability and bag-break strength.

Solution to Problem

A packaging bag of the present invention includes a easy-peel seal. The seal includes a first region in which multiple belt-shaped seals are spaced from each other in a width direction and a second region in which a single belt-shaped seal is disposed.

According to the packaging bag of the present invention, the multiple belt-shaped seals in the first region can achieve easy-opening properties. Further, since the single belt-shaped seal in the second region has higher bond strength than those in the first region, it can maintain the bag-break strength of the bag. Thus, when opening the bag, the consumer can easily open it from the first region; when the bag is not opened, the break-strength of the bag is maintained by the second region. Although the bond strength of the first region is low, the first region prevents the entry of water, since the multiple belt-shaped seals are disposed in the first region.

A packaging bag of the present invention includes a longitudinal seal having easy-opening properties. The longitudinal seal includes a first seal formed so as to be spaced from a film edge so that the first seal can be picked up with fingers and a second seal formed adjacent to the film edge.

According to the packaging bag of the present invention, the second seal is formed in a position closer to the opening than the first seal and therefore can prevent the entry of water. Different degrees of strength may be provided to the first region and second region when necessary. For example, by reducing the strength of the second seal compared to that of the first seal, it is possible to prevent the entry of water between the handle and the body and maintaining the openability.

Advantageous Effects of Invention

According to the present invention, it is possible to provide a packaging bag which can prevent the entry of water between the handle and the body, as well as can maintain proper degrees of openability and bag-break strength.

BRIEF DESCRIPTION OF THE DRAWINGS

FIG. 4(*b*) shows the state after the second heat sealing; and FIG. 4(*c*) shows the state after the third heat sealing.

FIG. 5(*b*) is a diagram showing a longitudinal seal when first regions are disposed without shifting them in the width direction.

FIG. 9(*b*) is a diagram showing a packaging bag in which a second seal is formed so as to be spaced from an opening.

DESCRIPTION OF EMBODIMENTS

Now, embodiments of a packaging bag according to the present invention will be described in detail with reference to the drawings.

First Embodiment

Figure 1:
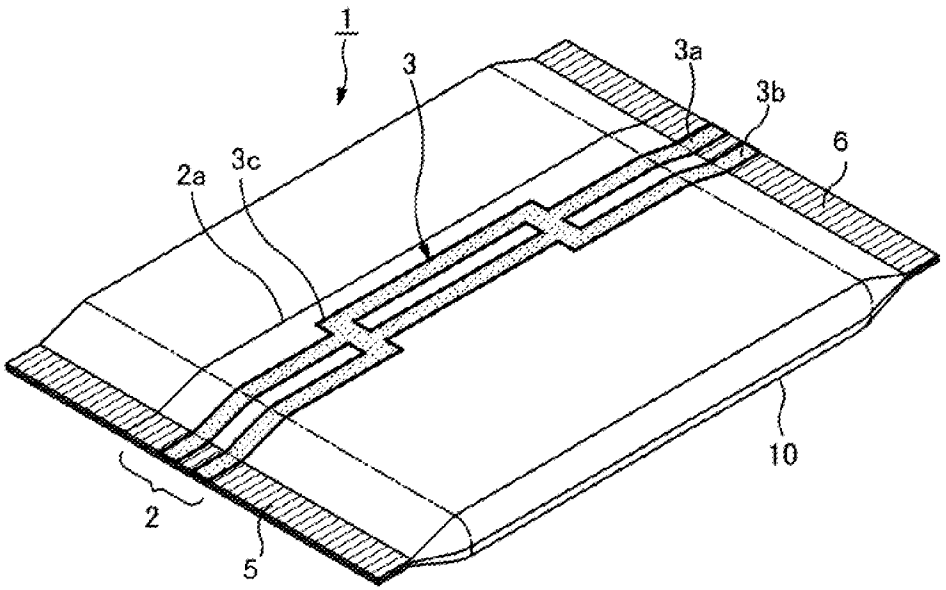
FIG. 1 is a perspective view of a packaging bag of a first embodiment of the present invention.

FIG. 1 is a perspective view of a packaging bag 1 of a first embodiment of the present invention. The packaging bag 1 is a three-side-sealed bag including an overlapping portion 2 formed by bending a multilayer film 10 into a tubular shape and then overlapping both side edges of the film, a longitudinal seal 3 disposed on the overlapping portion 2, and a lower transverse seal 5 and an upper transverse seal 6 formed at the edges in the length direction, of the longitudinal seal 3. A target object is contained in containing space formed in the packaging bag 1. The multilayer film 10 includes layers of resins having easy-peel properties, and an easy-peel part is formed by sealing the easy-peel resin layers to each other. As used herein, the resins having easy-peel properties refer to, for example, two or more resins which can be heat-sealed and which can form weak seals having a JIS K6854 peel strength of less than approximately 10N/15 mm width. The longitudinal seal 3 and transverse seals 5 and 6 are formed by heat-sealing the resin layers and thus have easy-peel properties such that the consumer can peel the seals by simply picking up and pulling a side edge of the overlapping portion 2. Of the layers of the multilayer film 10, at least layers to be sealed are formed of resins having easy-peel properties. For example, the multilayer film 10 can be formed by forming a film by lamination in such a manner that the inner and outer layers of the film are formed of a resin having easy-peel properties or forming a tubular film by extrusion blow molding in such a manner that the outermost layer of the extruded tubular film is formed of a resin having easy-peel properties and then flattening the tubular film. Even if the sealant layer is formed of a resin not having easy-peel properties, it is possible to form a easy-peel layer by adjusting the seal width, seal pressure or temperature, or the like, when necessary.

Figure 2:
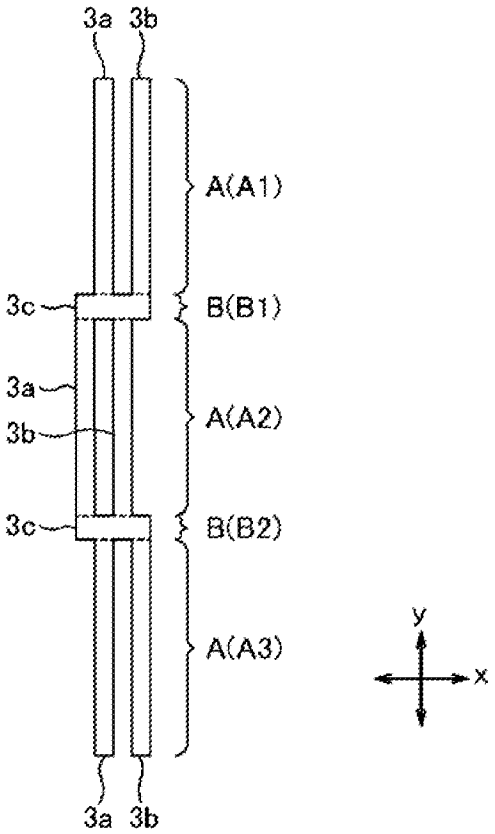
FIG. 2 is a drawing showing a longitudinal seal of the first embodiment.

FIG. 2 is a drawing showing the longitudinal seal 3. Note that broken lines in FIG. 2 are virtual lines for showing regions A and B and do not actually exist. The longitudinal seal 3 is a part formed by heat-sealing the resin having easy-peel properties. The longitudinal seal 3 is formed along an edge 2*a* of one side edge serving as the outer surface of the overlapping portion 2 in a state in which a non-sealed portion used as a handle when opening the bag is left on the edge 2*a*. In the longitudinal seal 3, first regions A and second regions B are alternately formed in the length direction y thereof. Specifically, a first region A1, a second region B1, a first region A2, a second region B2, and a first region A3 are disposed in this order in the length direction y of the longitudinal seal 3.

In each first region A, multiple belt-shaped seals, a first belt-shaped seal 3*a* and a second belt-shaped seal 3*b*, are spaced from each other by a predetermined distance approximately in parallel. The first regions A1 and A2, which are connected to the opposite edges of the second region B1, are shifted from each other in the width direction x of the longitudinal seal 3. Similarly, the first regions A2 and A3, which are connected to the opposite edges of the second region B2, are shifted from each other in the width direction x.

In each second region B, a single belt-shaped seal 3*c* is disposed. Each belt-shaped seal 3*c* is formed with a wide width so that the multiple belt-shaped seals, 3*a* and 3*b*, in the corresponding first regions A can be connected to the belt-shaped seal 3*c*. Specifically, for the belt-shaped seal 3*c* in the second region B1, one side edge thereof in the width direction reaches one side edge of the second belt-shaped seal 3*b* in the first region A1, and the other side edge reaches the other side edge of the first belt-shaped seal 3*a* in the first region A2. As seen above, the belt-shaped seal 3*c* is formed in such a manner that the belt-shaped seals 3*a* and 3*b* in both the first regions A1 and A2 can be connected thereto. Similarly, the belt-shaped seal 3*c* in the second region B2 are formed in such a manner that the belt-shaped seals 3*a* and 3*b* in both the first regions A2 and A3 can be connected thereto. Preferably, the width of the single seal (i.e., the width of the second region B) is larger than the width of the multiple seals (i.e., the width of the first region A). Further, the width of the single seal may be larger than the width of each of the multiple seals or may be larger than the total width of the multiple seals.

In the packaging bag 1 of the present embodiment, by adjusting the width of the multiple seals in the first region A and the width of the single seal in the second region B, the belt-shaped seal 3*c* of the second region B is formed with a wide width so that the belt-shaped seals 3*a* and 3*b* in the corresponding first region A can be connected thereto. Thus, the bond strength of the second region B is increased compared to that of the first region A, and the bag-break strength of the bag can be maintained. On the other hand, when opening the packaging bag 1, the consumer picks up an edge of the overlapping portion 2 to peel the longitudinal seal 3. At this time, the longitudinal seal 3 is easily peeled, starting with the belt-shaped seals 3*a* and 3*b* in the first region A. Thus, openability is maintained. In general, a narrow seal has good openability, but such a seal is poor in bag-break strength. For this reason, by disposing multiple narrow seals in parallel, the entry of water is prevented. Further, even when one of the narrow seals is peeled, the leakage of the contents can be prevented, since the other seal remains. Accordingly, openability is maintained while preventing the entry of water or preventing the leakage of the contents. However, simply providing multiple narrow seals does not provide sufficient bag-break strength. In the present embodiment, on the other hand, by using the single wide seal together, bag-break strength is significantly improved. In this case, openability is not significantly impaired. The reason is that since the consumer opens the bag from the multiple narrow seals, he or she can also peel the wide seal with momentum based on the shear force. Note that the shape of the longitudinal seal in the packaging bag 1 is not limited to that in the present embodiment and various shapes may be employed. For example, a single seal may be disposed only in the central portion of the bag, in which the bag is likely to be broken, in order to maintain bag-break strength, and multiple seals may be disposed near the transverse seals at both edges of the bag. Thus, when opening the bag, the consumer can easily open the edge. Further, by opening the bag from the edge sequentially, the consumer can also easily open the central portion, in which the single seal is formed.

Figure 3:
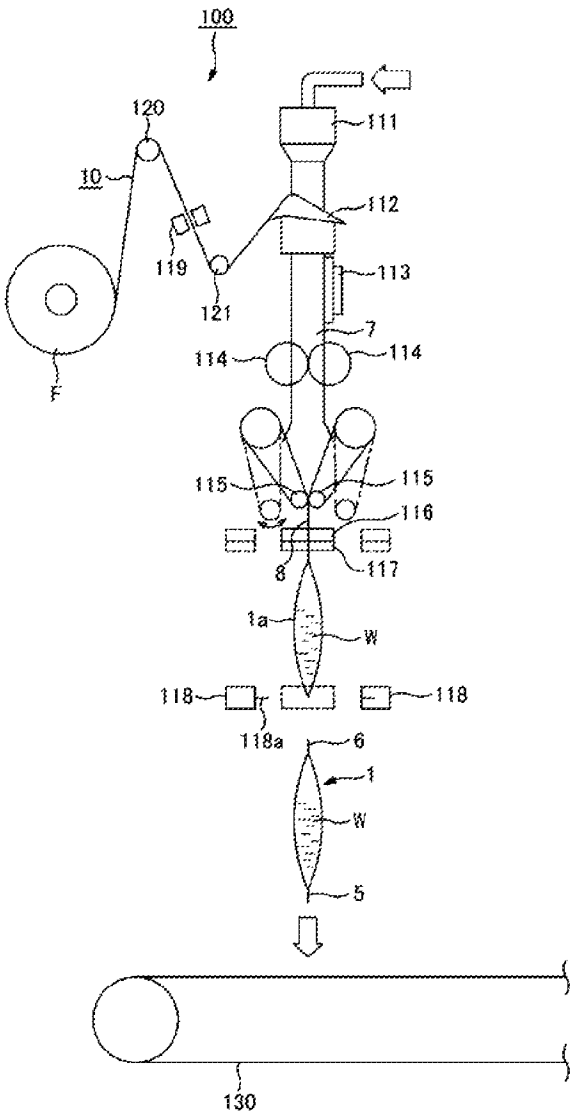
FIG. 3 is a diagram showing a method for manufacturing the packaging bag of the first embodiment.

Next, a method for manufacturing the packaging bag 1 will be described using an example in which the packaging bag 1 is manufactured using a pillow packaging machine 100 shown in FIG. 3. The manufacturing method includes the following sequential steps: a first step in which a multilayer film 10 is formed into a tubular shape; a second step in which a longitudinal seal 3 is formed; a third step in which a lower transverse seal 5 is formed; a fourth step in which a target object is charged; a fifth step in which an upper transverse seal 6 is formed; and a sixth step in which the boundaries between connected bags are cut. The respective steps will be described below.

The first step in which a twofold multilayer film is formed into a tubular shape: a multilayer film 10 obtained from a roll original film F travels around feed rolls 120 and 121 and is led to a former 112. A sensor 119 disposed on the path from the roll original film F to the former 112 detects register marks printed on multilayer films 10 at predetermined distances in the length direction so that the multilayer films 10 each having a predetermined length can be fed onto the path in the pillow packaging machine 100 at predetermined time intervals. During the passage through the former 112, each multilayer film 10 is bent into a tubular body in which both side edges of the bent multilayer film overlap each other. An overlapping portion 2 is formed in the overlapping region.

The second step in which a longitudinal seal is formed: the overlapping portion 2 of the multilayer film 10 is heat-sealed by a longitudinal sealer 113 to form a longitudinal seal 3. At this time, the longitudinal sealer 113 performs heat sealing by contacting or separating the contact surfaces thereof with or from the overlapping portion 2 at the timing when the multilayer film 10 moves at predetermined time intervals.

Figure 4:
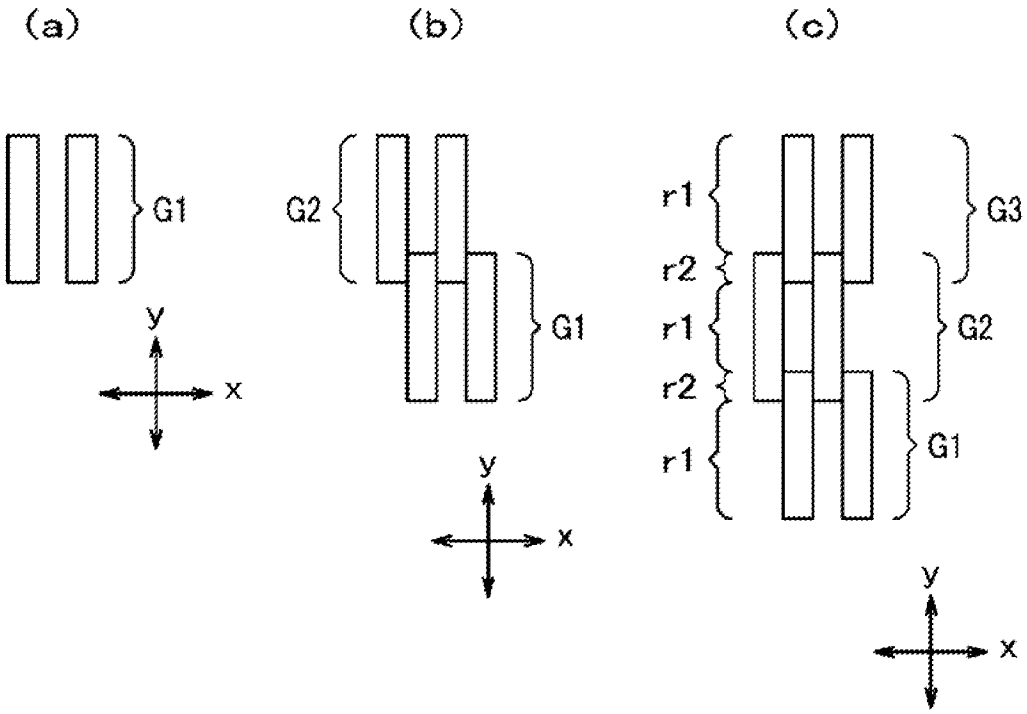
FIG. 4 includes diagrams showing a longitudinal seal formed using the method for manufacturing the packaging bag of the first embodiment, in which FIG. 4(*a*) shows the state after the first heat sealing.

FIG. 4 includes diagrams chronologically showing the longitudinal seal 3 formed in the second step. In the longitudinal sealer 113, the contact surfaces of the two seal bars which come into contact with the overlapping portion 2 each have a belt shape having a predetermined length, and the contact surfaces are spaced from each other by a predetermined distance. First, the longitudinal sealer 113 is placed on standby with the contact surfaces separated from the overlapping portion 2. When the target region of the overlapping portion 2 is fed along the length direction y, the longitudinal sealer 113 performs the first heat sealing by pressing the contact surfaces against the overlapping portion 2. After the heat sealing is completed, the longitudinal sealer 113 separates the contact surfaces from the overlapping portion 2 and then waits for a subsequent target region to be fed. In the first heat sealing, as shown in FIG. 4(*a*), two belt-shaped seals having a predetermined length are formed so as to be spaced from each other by a predetermined distance. Hereafter, a group of the belt-shaped seals formed in the first heat sealing will be referred to as the first group G1.

Subsequently, when the subsequent target region is fed along the length direction y, the longitudinal sealer 113 performs the second heat sealing by pressing the contact surfaces against that region. At this time, the contact surfaces of the longitudinal sealer 113 and the overlapping portion 2 are relatively moved to predetermined positions in the width direction x. Thus, as shown in FIG. 4(*b*), the belt-shaped seals formed in the second heat sealing (belt-shaped seals of a second group G2) are formed in positions shifted from the belt-shaped seals of first group G1 in the width direction x and length direction y. The amounts of shift are adjusted so that one edge of the belt-shaped seal of the first group G1 and the other edge of the corresponding belt-shaped seal of the second group G2 are alternately disposed in the width direction x without any gap.

As with the second heat sealing, the third heat sealing is performed to form belt-shaped seals (belt-shaped seals of a third group G3). Thus, as shown in FIG. 4(*c*), the other edge of the belt-shaped seal of the second group G2 and one edge of a corresponding belt-shaped seal of the third group G3 are alternately disposed in the width direction x without any gap. As a result, there are formed regions r2 in which the belt-shaped seals are alternately disposed without any gap and regions r1 in which the multiple belt-shaped seals are spaced.

The third step in which a lower transverse seal is formed: the multilayer film 10 having the longitudinal seal formed thereon is fed downstream in the form of a tubular body 7. When a squeeze roll 115, which can be opened and closed, is closed, the tubular body 7 is squeezed and flattened; and when the transversely sealing machines 116 and 117 are closed, a lower transverse seal 5 is formed in a predetermined position of the flattened tubular body 8.

The fourth step in which a target object is charged: a predetermined amount of a target object W is introduced into a hopper 111 and then charged into the tubular body 8.

The fifth step in which an upper transverse seal is formed: a yet-to-be-separated packaging bag 1*a*, as well as the tubular body 7 and a predetermined length of the multifold multilayer film 10 following the tubular body are fed by opening the squeezing roll 115 and transversely sealing machines 116 and 117 and then rotating the feed roll 114. Subsequently, the transversely sealing machines 116 and 117 are closed to heat-seal a predetermined position, thereby forming an upper transverse seal 6, as well as forming a lower transverse seal 5 connected to the upper transversely sealed part 6, of a subsequent packaging bag located upstream of the path.

The sixth step in which the boundary between the connected bags are cut: a press/cutter 118 is closed to press the lower transverse seal 5 of the yet-to-be-separated packaging bag la and the upper transverse seal 6 connected to the transversely sealed part 5, then cuts the boundary between both bags, and drops a packaging bag 1 onto a conveyor 130.

In this way, the packaging bag 1 shown in FIG. 1 is manufactured. The regions r1, in which the multiple belt-shaped seals are spaced from each other by the predetermined distance, and the regions r2, in which the belt-shaped seals are alternately disposed without any gap are formed on the packaging bag 1 manufactured. Each region r1 has a function of maintaining the proper openability, as a first region A. On the other hand, each region r2 has the multiple belt-shaped seals disposed therein without any gap and therefore serves as a single belt-shaped seal as a whole. Thus, the region r2 has a function of maintaining the proper bag-break strength, as a second region B.

Further, the openability of the packaging bag 1 is improved as the proportion of the first regions A is increased; the bag-break strength thereof is increased as the proportion of the second regions B is increased. According to the manufacturing method of the present embodiment, the first regions A and second regions B can be formed by shifting the pair of seal bars or the film in the second step. Further, the amount of shift of the belt-shaped seals in the length direction y can be adjusted by changing the distance between the seals. Thus, it is possible to change the composition ratio between the first regions A and second regions B in the longitudinal seal 3. Accordingly, it is possible to easily adjust the openability and bag-break strength of the longitudinal seal 3.

While the first embodiment of the present invention has been described, the invention is not limited thereto, as a matter of course. Various changes or modifications can be made thereto without departing from the spirit and scope of the invention.

For example, three or more belt-shaped seals may be disposed in each first region. Further, the respective numbers of the first regions and second regions which are alternately disposed in the length direction y are not limited to those in the present embodiment and may be larger or smaller. The belt-shaped seals alternately disposed without any gap in each second region may overlap in part each other in the width direction x and length direction y.

Figure 5:
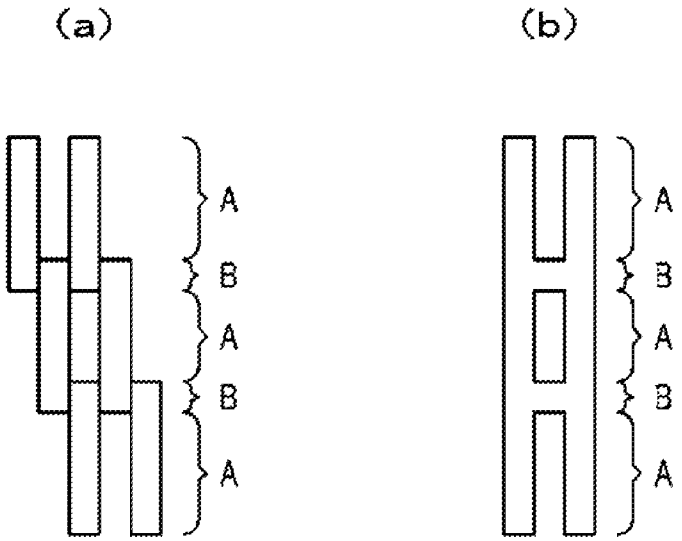
FIG. 5 includes diagrams showing another example of the first embodiment, in which FIG. 5(*a*) is a diagram showing a longitudinal seal when a first region is shifted only in one direction of the width direction.

Further, as shown in FIG. 5(*a*), instead of shifting a first region A leftward and rightward alternately, a first region A may be shifted leftward or rightward continuously. Further, it is not always necessary to form a second region B consisting of the single belt-shaped seal by shifting the sealing positions of the multiple parallel seal bars. For example, as shown in FIG. 5(*b*), first regions A and second regions B may be formed by performing sealing once using seal bars having a shape capable of forming both regions, without having to shift the seal bars in the width direction.

Further, the packaging bag may be formed as a single-fold multilayer film, or the overlapping portion may be formed by butt seaming.

Further, the manufacturing method is not limited to that in the present embodiment. For example, first regions and second regions may be formed using a seal bar for forming first regions and a seal bar for forming second regions, respectively.

Second Embodiment

Figure 6:
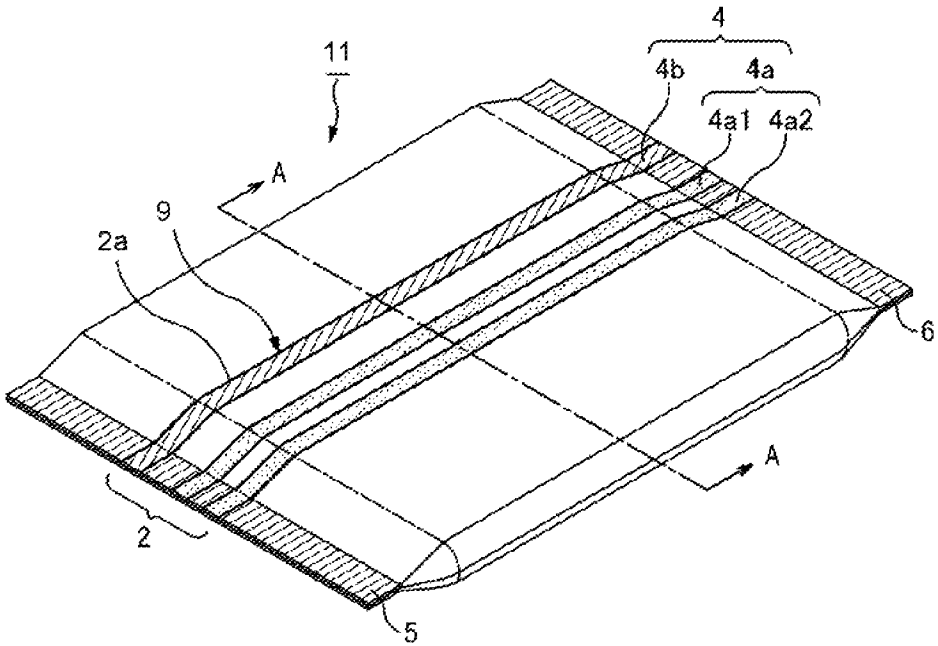
FIG. 6 is a perspective view of a packaging bag of a second embodiment of the present invention.
Figure 7:
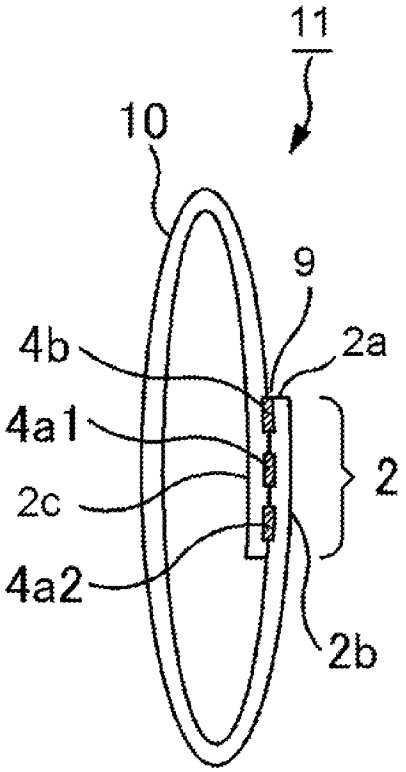
FIG. 7 is an A-A sectional view of the packaging bag of the second embodiment.

A packaging bag of a second embodiment of the present invention can maintain openability, as well as can prevent entry of water between the handle and the body. In the present embodiment, there will be described, as an example, an envelope seamed packaging bag in which edges of a film are stacked and longitudinally sealed. FIG. 6 is a perspective view of a packaging bag 11 of the present embodiment, and FIG. 7 is an A-A sectional view of the packaging bag 11. The configuration of the packaging bag 11 is approximately the same as that of the first embodiment except for the configuration of the longitudinal seal. The same elements as those of the first embodiment are given the same reference signs and will not be described. An envelope seamed longitudinal seal 4 and transverse seals 5 and 6 are formed by heat-sealing a peelable sealant layer and thus have easy-peel properties. When the consumer takes out a target object from the packaging bag 11, he or she peels the longitudinal seal 4 to open an opening 9. Note that the consumer may further open the transverse seal 5 or 6 when necessary.

The opening 9 includes an edge 2*a* of an outer side edge 2*b* of an overlapping portion 2 on the outer surface of the packaging bag and an inner side edge 2*c* of the overlapping portion 2 on the inner surface of the packaging bag. That is, the opening 9 is formed at the edge adjacent to the edge 2*a* of the overlapping portion 2.

The longitudinal seal 4 includes a first seal 4*a* and a second seal 4*b*.

The first seal 4*a* is formed so as to be spaced from the edge 2*a* by at least a predetermined distance so that the consumer can pick up the edge 2*a* or its vicinities with fingers when opening the bag. The first seal 4*a* includes two belt-shaped seals, 4*a*1 and 4*a*2, which are approximately parallel with the edge 2*a*. While the first seal 4*a* includes the two belt-shaped seals considering both openability and bag-break strength, the first seal 4*a* need not necessarily include multiple belt-shaped seals and may include a single belt-shaped seal.

The second seal 4*b* is formed in a position closer to the opening 9, which is an edge of the film, than the first seal 4*a*. In particular, in the present embodiment, the second seal 4*b* is disposed at an edge adjacent to the opening 9 in a belt shape. Specifically, the second seal 4*b* is formed at an edge adjacent to the edge 2*a* of the overlapping portion 2 in a belt shape. The second seal 4*b* is preferably formed on the edge in order to prevent the entry of water into the edge, but it does not necessarily have to be formed on the edge. The second seal 4*b* only has to be formed near and along the edge. The second seal 4*b* is preferably formed in such a manner that it has lower strength than the first seal 4*a* and thus the consumer can easily open it with a weak force. That is, the second seal 4*b* only has to prevent the entry of water when the bag is water-cooled in the bag manufacturing process, and it preferably has as low strength as possible in terms of openability. On the other hand, the first seal 4*a* is preferably provided with a certain degree of strength so that it is not peeled unintentionally, for example, when the bag is carried. However, it is not preferable to provide the first seal 4*a* with too high strength, since such a first seal 4*a* is difficult to open without using some tool. Since the first seal 4*a* includes the multiple parallel seals, the other seal reliably remains even when one of the seals is peeled. Thus, both openability and bag-break strength can be achieved. The strength of the seals can be adjusted, for example, by heat-sealing the second seal 4*b* with a lower heating temperature than that of the first seal 4*a*, or contacting the seal bars with the film with a smaller force when forming the second seal 4*b* than when forming the first seal 4*a*.

The packaging bag 11 may be water-cooled with the opening 9 sealed, depending on the type of the target object. At this time, there may occur problems such as the entry of water into the overlapping portion 2 through the opening 9. However, the second seal 4*b* is formed in a position closer to the opening 9 than the first seal 4*a* in the packaging bag 11. Thus, the second seal 4*b* can prevent the entry of water On the other hand, if the strength of the second seal 4*b* is extremely low, it may be peeled unintentionally and thus water may enter the overlapping portion 2. Even in this case, the entering water is small in amount. When the consumer takes out the target object, he or she peels the longitudinal seal 4 to open the opening 9. In this case, if the strength of the second seal 4*b* is as low as possible and the first seal 4*a* has easy-peel properties to the extent that the bag is not unintentionally broken, the consumer can first peel the second seal 4*b* easily and then peel the first seal 4*a* while picking up the film edge. Thus, the consumer can open the bag without difficulty, and the openability of the opening 9 is not impaired.

Particularly, in the second embodiment, the second seal 4*b* is formed at the edge adjacent to the opening 9 and therefore can prevent the entry of water at the forefront when the bag contacts water. Thus, extremely high waterproof effects can be obtained.

Next, a method for manufacturing the packaging bag 11 will be described. A pillow packaging machine 100 used in this manufacturing method is approximately the same as that shown in FIG. 3 except for the shape of the contact surfaces of the seal bars of the longitudinal sealer 113. Since the manufacturing method is approximately the same as that of the first embodiment, there will be described only a second step in which a longitudinal seal is formed, which is a feature of the second embodiment.

The second step in which a longitudinal seal is formed: the longitudinal sealer 113 heat-seals the overlapping portion 2 of the multilayer film 10 by contacting or separating the contact surfaces of the seal bars with or from the overlapping portion 2 at the timing when a multilayer film 10 moves at predetermined time intervals, thereby forming first seals 4*a*1 and 4*a*2 and a second seal 4*b*. That is, in the present embodiment, the step in which the first seals 4*a*1 and 4*a*2 are formed and the step in which the second seal 4*b* is formed are performed simultaneously. Note that the first seal 4*a* and second seal 4*b* need not necessarily be formed simultaneously. For example, after the first seal 4*a* is formed, the second seal 4*b* may be formed in a subsequent step.

Figure 8:
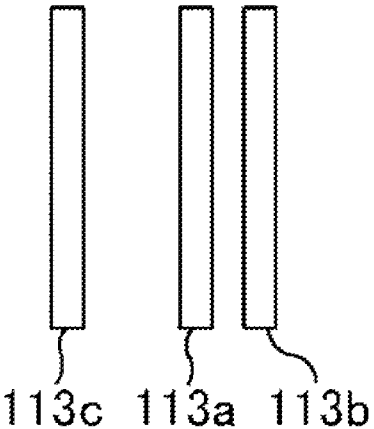
FIG. 8 is a diagram showing a longitudinal sealer used in a method for manufacturing the packaging bag of the second embodiment and is a diagram showing contact surfaces pressed against a twofold multilayer film for heat sealing.

FIG. 8 is a drawing showing the contact surfaces of the longitudinal sealer 113. A contact surface 113*a*, a contact surface 113*b*, and a contact surface 113*c* are side surfaces of the seal bars which are pressed against the overlapping portion 2. The contact surface 113*a*, which corresponds to one of the first seals, 4*a*1, the contact surface 113*b*, which corresponds to the other first seal, 4*a*2, and the contact surface 113*c*, which corresponds to the second seal 4*b*, are spaced from each other by appropriate distances approximately in parallel. The respective heating temperatures or pressing forces can be independently adjusted. When performing heat-sealing, the contact surfaces 113*a* and 113*b* for forming first seals 4*a*1 and 4*a*2 are set to a heating temperature and pressing force suitable for easy-peel properties. On the other hand, the contact surface 113*c* forming a second seal 4*b* is set to a lower heating temperature or pressing force than that of the contact surfaces 113*a* and 113*b*. Note that by forming positions for forming first seals and a position for forming a second seal on the same seal bar and then changing the heights of the positions with respect to the contact direction, that is, disposing the position corresponding to the formation of the second seal, whose strength is to be lower, in a position lower than the positions corresponding to the formation of the first seals, it is possible to form a second seal 4*b* having lower strength than that of the first seals 4*a* even when forming these seals simultaneously on the same seal bar with the same pressure. Thus, it is possible to form the first seals 4*a*1 and 4*a*2 and second seal 4*b* simultaneously in such a manner that the second seal 4*b* has lower strength than that of the first seals 4*a*.

Note that the heating temperature and pressing force of the contact surface 113*c* only has to achieve the low strength of the second seal 4*b* in concert with each other. Accordingly, even when one of the heating temperature and pressing force thereof is greater than or equal to that of the contact surfaces 113*a* and 113*b*, there is no problem. As another method, the strength of the seals may be adjusted by reducing the time of heat sealing performed by the contact surface 113*c* compared to that of the contact surfaces 113*a* and 113*b* or by adjusting the seal widths.

After the step in which a longitudinal seal 4 is formed, a lower transverse seal 5 is formed; a target object is charged; an upper transverse seal 6 is formed; and the boundaries of the connected bags are cut. Thus, the packaging bag 11 shown in FIG. 6 is manufactured. The packaging bag 11 manufactured has the first seals 4*a*1 and 4*a*2 and second seal 4*b* formed thereon. Subsequently, the bag is water-cooled so that the target object W is sufficiently cooled and then the bag is dried to evaporate the water. At this time, the second seal 4*b* formed along the film edge can prevent the entry of water into the overlapping region of the film, thereby preventing the water from remaining in the packaging bag. According to this manufacturing method, it is possible to simultaneously form first seals 4*a*1 and 4*a*2 and second seal 4*b* which have different degrees of strength. Further, it is sufficient to provide a single sealant layer, that is, there is no need to provide multiple sealant layers having different degrees of strength corresponding to first seals 4*a*1 and 4*a*2 and second seal 4*b*.

While the second embodiment of the present invention has been described, the invention is not limited thereto, as a matter of course. Various changes or modifications can be made thereto without departing from the spirit and scope of the invention.

For example, a single or three or more first seals may be formed, or multiple second seals may be formed. Further, the first seals or second seal may be formed as strong seals, which have high strength, rather than as easy-peel seals.

Figure 9:
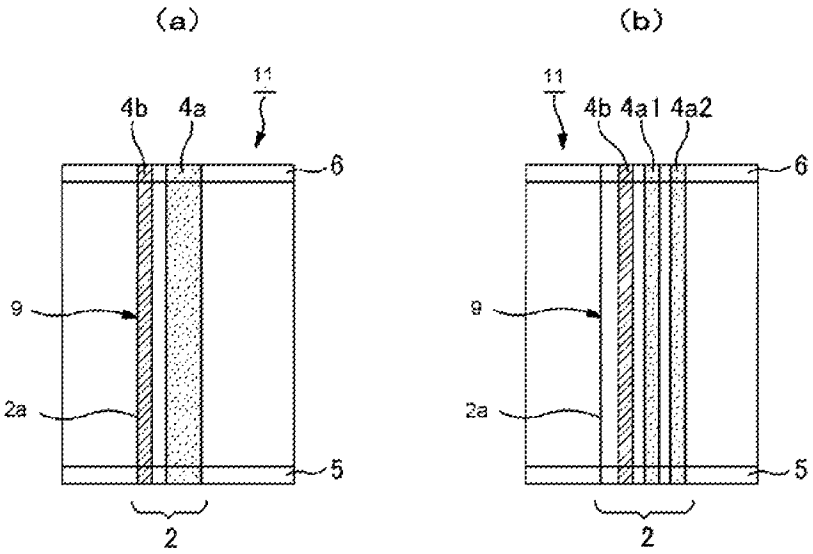
FIG. 9 includes diagram showing another example of the second embodiment, in which FIG. 9(*a*) is a diagram showing a packaging bag in which the seal strength is adjusted by providing different widths to first region and second region.

Further, as shown in FIG. 9(*a*), the seal strength may be adjusted by forming a wide first seal 4*a* and a narrow second seal 4*b*.

Further, as shown in FIG. 9(*b*), a second seal 4*b* may be formed so as to be spaced from an opening 9. In this case, a region which the consumer can pick up with fingers when opening the bag is formed, thereby improving ease of use.

Further, the packaging bag may be formed as a monolayer film or may be formed as a multilayer film including two or more layers. The packaging bag may also be a twofold film which is composed of a multilayer film in which layers are bonded together in a pseudo manner or a multilayer film formed by flattening a tubular film extruded by extrusion blow molding.

Further, the overlapping portion of the packaging bag may be formed by butt seaming. In this case, the overlapping portion may be erect, or may be prone by folding it. Further, the second seal may be formed so as to be located at the edge, or the second seal may be formed so as to be spaced from the edge and then the edge may be folded so that the bag can be opened from both sides.

Further, the manufacturing method is not limited to that of the second embodiment. For example, the first seals and second seal may be formed at different timings.

DESCRIPTION OF NUMERALS

1, 11 packaging bag
1*a* yet-to-be-separated packaging bag
2 overlapping portion
2*a* edge of side edge of outer surface of overlapping portion
3 longitudinal seal
3*a*, 3*b* belt-shaped seal in first region
3*c* belt-shaped seal in second region
4 longitudinal seal
4*a* first seal
4*b* second seal
5 lower transverse seal
6 upper transverse seal
9 opening
100 packaging machine
113 longitudinal sealer
A, A1, A2, A3 first region B, B1, B2 second region
G1 first group°
G2 second group°
G3 third group

The invention claimed is:

1. An envelope seamed packaging bag in which edges of a film are stacked and longitudinally sealed, comprising an easy-peel seal, wherein the seal comprises at least two first regions in which a plurality of belt-shaped seals are spaced from each other in a direction substantially parallel to a longitudinal direction of the seal and a second region in which a single belt-shaped seal is disposed in a direction substantially perpendicular to the longitudinal direction of the seal, the first regions and the second region being alternately formed in a length direction of the seal, wherein the first regions, which are connected to a plurality of opposite edges of the second region, are shifted from each other in the width direction, and the second region has a corner.

2. The packaging bag of claim 1, wherein a width of the single belt-shaped seal is larger than a width of each of the plurality of belt-shaped seals.

3. The packaging bag of claim 1, wherein the seal is a longitudinal seal.

4. The packaging bag of claim 1, wherein the seal is formed by shifting sealing positions of a plurality of seal bars in the width direction, the seal bars being arranged in parallel.

5. An envelope seamed packaging bag in which edges of a film are stacked and longitudinally sealed comprising:

an overlapping portion formed by overlapping an outer surface of a first edge and an inner surface of a second edge of a multilayer film, the multilayer film having a peelable sealant layer;

a longitudinal seal disposed along a longitudinal direction of the overlapping portion; and a transverse seal, which is formed at edges in a length direction of the longitudinal seal, wherein the longitudinal seal comprises a first seal formed so as to be spaced from a film edge so that the film edge can be picked up with fingers and a second seal formed adjacent to the film edge, the first seal and the second seal being formed on the same plane, wherein a sealing strength of the second seal is lower than a sealing strength of the first seal, wherein the overlapping portion is sealed by the first seal, the second seal, and the transverse seal, wherein the first seal and the second seal have a length that is substantially the same as the distance between both longitudinal end portions of the longitudinal seal.

* * * * *